US012740655B1

(12) United States Patent
Nau

(10) Patent No.: US 12,740,655 B1
(45) Date of Patent: Sep. 22, 2026

(54) CHANGING PAD DEVICE WITH LEG HOLDERS

(71) Applicant: Kelepi Api Kae Lau'i Nau, Salinas, CA (US)

(72) Inventor: Kelepi Api Kae Lau'i Nau, Salinas, CA (US)

( * ) Notice: Subject to any disclaimer, the term of this patent is extended or adjusted under 35 U.S.C. 154(b) by 0 days.

(21) Appl. No.: 19/243,356

(22) Filed: Jun. 19, 2025

Related U.S. Application Data

(60) Provisional application No. 63/671,599, filed on Jul. 15, 2024.

(51) Int. Cl.
*A47D 5/00* (2006.01)
*A47D 15/00* (2006.01)

(52) U.S. Cl.
CPC ..... *A47D 5/00* (2013.01); *A47D 15/005* (2013.01)

(58) Field of Classification Search
CPC ..... A47D 5/00; A47D 15/005; A61G 7/1009
USPC ..... 5/655
See application file for complete search history.

(56) References Cited

U.S. PATENT DOCUMENTS 2,792,266 A * 5/1957 Waters ..... A61G 13/12 5/624
10,058,193 B2 * 8/2018 Karavias ..... A61F 13/84
2014/0359946 A1 * 12/2014 Kong ..... A47D 5/006 5/655
2016/0324331 A1 * 11/2016 Karavias ..... A61F 5/3769
2020/0229616 A1 * 7/2020 Paap ..... A47D 13/08

FOREIGN PATENT DOCUMENTS

CN 215937878 U * 3/2022
JP H09276342 A * 10/1997
JP 2003164479 A * 6/2003
JP 3115283 U * 11/2005
JP 2024085344 A * 6/2024
WO WO-2015072705 A1 * 5/2015 ..... A47D 5/006

OTHER PUBLICATIONS

Trans, CN-215937878-U (Year: 2026).*
Trans. JP-2003164479-A (Year: 2026).*
Trans. JP-2024085344-A (Year: 2026).*
Trans. JP-3115283-U (Year: 2026).*
Trans. JP-H09276342-A (Year: 2026).*
Trans. WO-2015072705-A1 (Year: 2026).*

* cited by examiner

*Primary Examiner* — J. T. Newton
(74) *Attorney, Agent, or Firm* — Plager Schack LLP; Mark H. Plager; Kara K. Verryt

(57) ABSTRACT

A baby changing device for securing legs of an individual during a diaper change may include a base; a pair of arms oriented parallel to one another and extending upwards from opposite edges of the base; a support rod extending between upper ends of the pair of arms; and a pair of stirrups slidably and rotatably attached to the support rod, wherein each stirrup is substantially U-shaped and sized to cradle the individual's ankles.

8 Claims, 4 Drawing Sheets

CHANGING PAD DEVICE WITH LEG HOLDERS

RELATED APPLICATION

This application claims priority to provisional patent application U.S. Ser. No. 63/671,599 filed on Jul. 15, 2024, the entire contents of which is herein incorporated by reference.

BACKGROUND

The embodiments described herein relate generally to baby products and, more particularly, to a changing pad device that holds and secures a baby's legs to assist in changing diapers.

Changing a baby's diaper can be difficult, especially as the child ages and gets heavier. Often times, a caregiver must use one hand to hold the feet and the other for wiping, which can be difficult, time consuming, and ineffective. Caregivers often experience discomfort or fatigue from lifting and holding their baby during diaper changes. Unfortunately, conventional changing bads do not include a structure of mechanism for helping to secure the legs in an upward position.

Therefore, what is needed is a an updated changing bad with a structure for securing a baby, child, or other individual's legs in a manner that provides for easier wiping.

SUMMARY

Some embodiments of the present disclosure include a baby changing device for securing legs of an individual during a diaper change. The device may include a base; a pair of arms oriented parallel to one another and extending upwards from opposite edges of the base; a support rod extending between upper ends of the pair of arms; and a pair of stirrups slidably and rotatably attached to the support rod, wherein each stirrup is substantially U-shaped and sized to cradle the individual's ankles.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
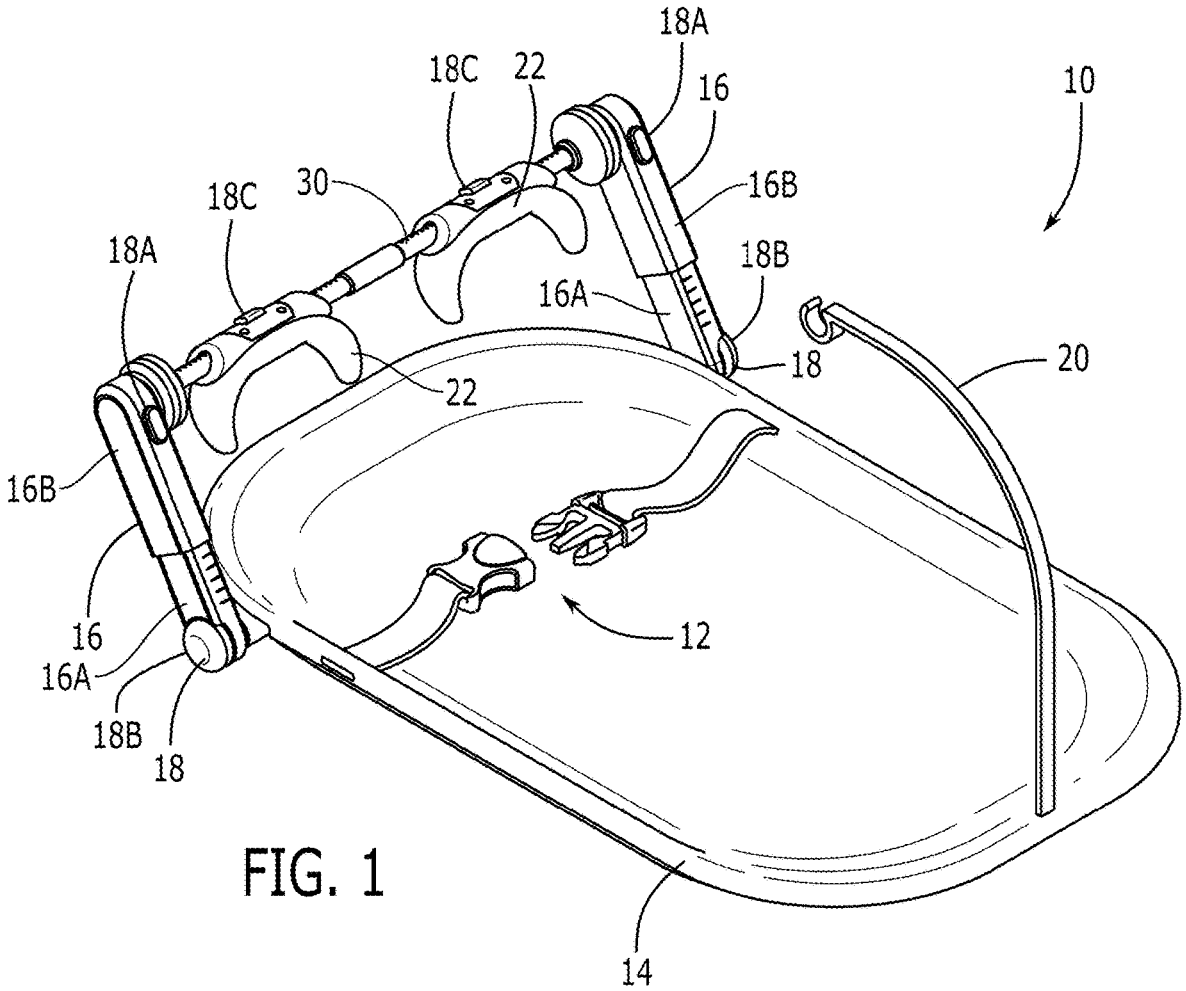
FIG. 1 is a top perspective view of one embodiment of the present disclosure.
Figure 2:
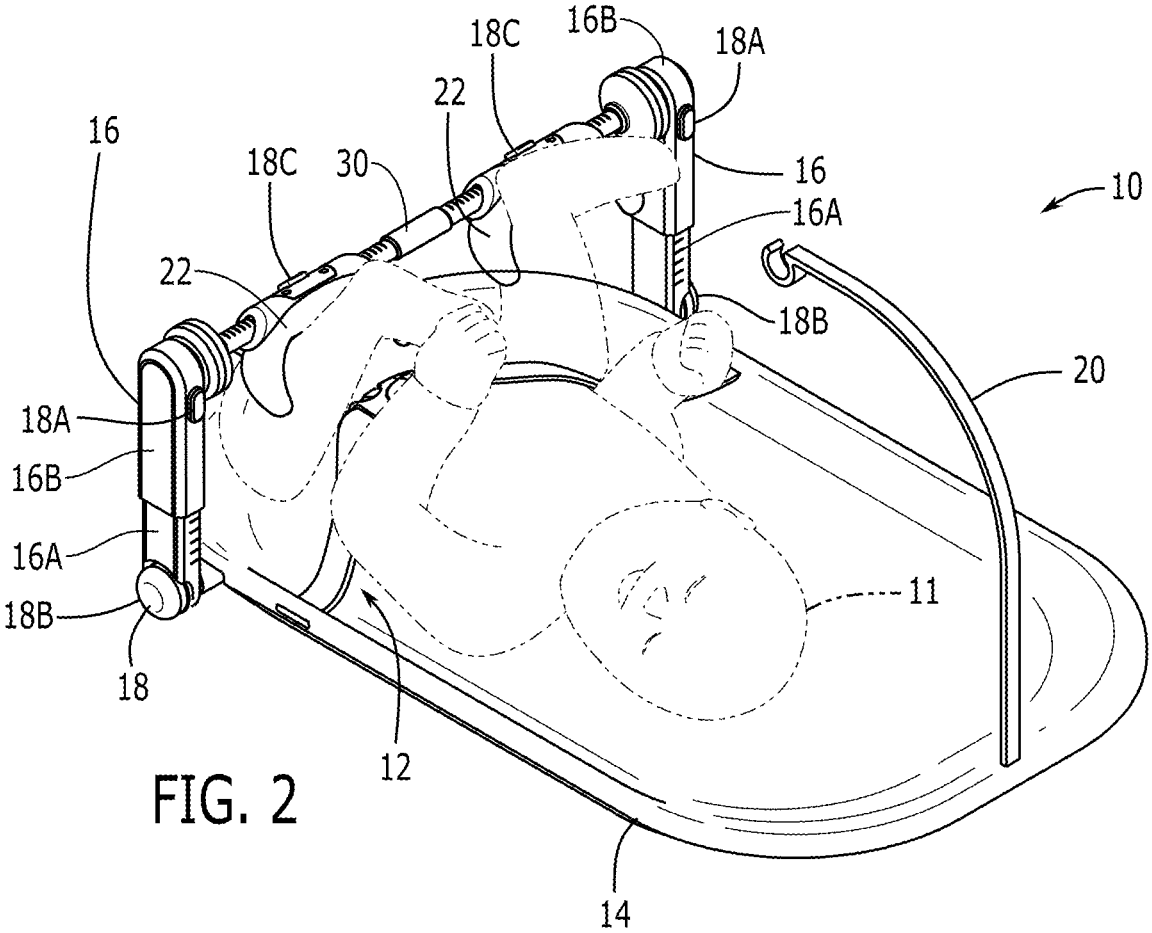
FIG. 2 is a perspective view of one embodiment of the present disclosure, shown in use.
Figure 3:
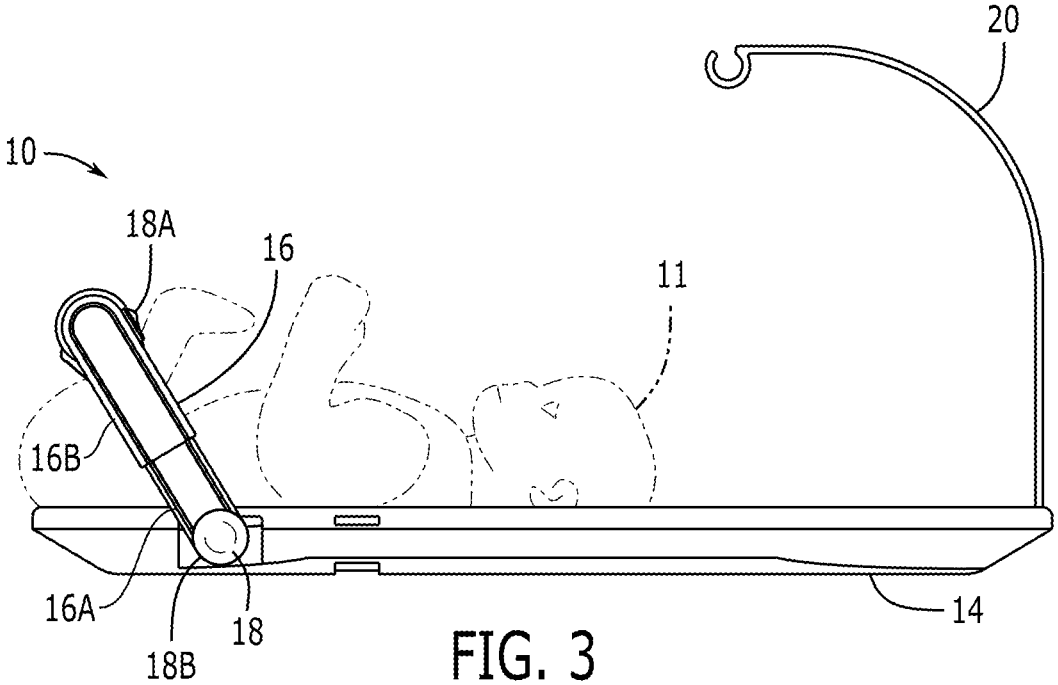
FIG. 3 is a side elevation view of one embodiment of the present disclosure, shown in use.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an improved changing pad and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-4, some embodiments of the present disclosure include a baby changing device 10 for securing legs of an individual, such as baby 11, such as a baby at least 6 months of age, during a diaper change, the device 10 comprising a base 14, a pair of arms 16 comprising a first arm and a second arm attached to respective opposite edges of the base 14, such that the first arm and the second arm are substantially parallel to one another; a rod 30 extending between upper ends of the first arm and the second arm; and a pair of stirrups 22 slidably attached to the rod 30, wherein each stirrup 22 of the pair of stirrups 22 is substantially U-shaped and sized to cradle the individual's ankles.

More specifically, and as shown in the Figures, the base 14 may comprise a stable, cushioned panel to support the individual being changed. In embodiments, the base 14 may be waterproof, soft, and non-slip to ensure comfort and safety. As shown in the Figures, the base 14 may be substantially oblong-shaped and concave, such that the outer edges of the base 14 taper upward with respect to a central region of the base 14.

Figure 4:
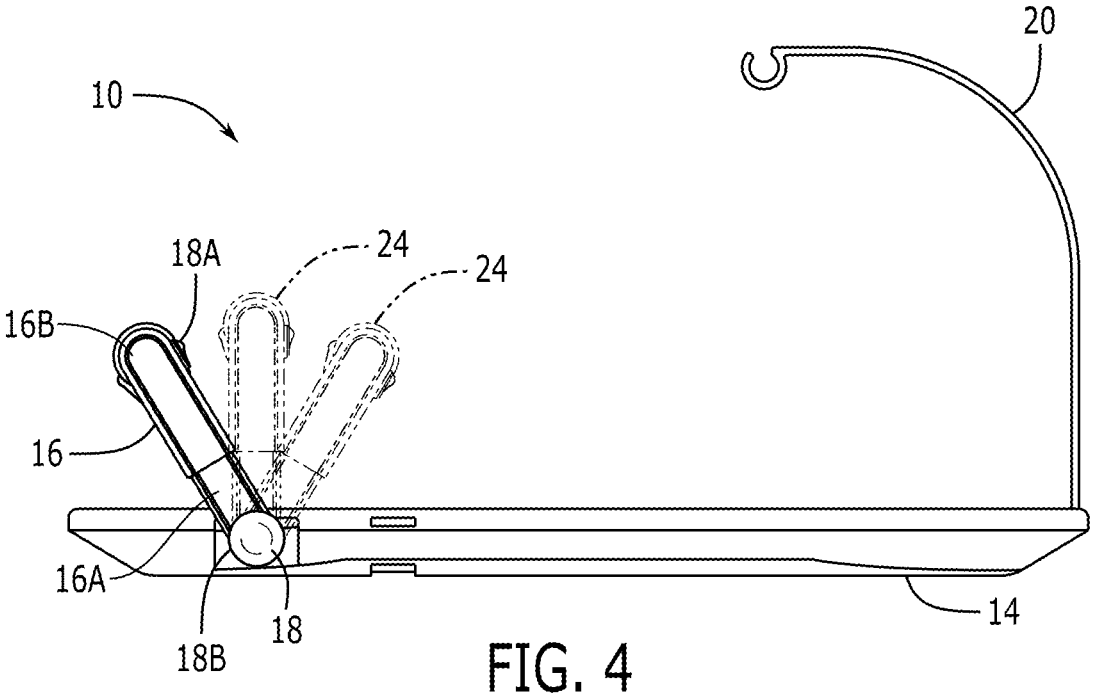
FIG. 4 is a side elevation view of one embodiment of the present disclosure, showing various rotational positions 24 of the arms 16 in phantom.
Figure 5:
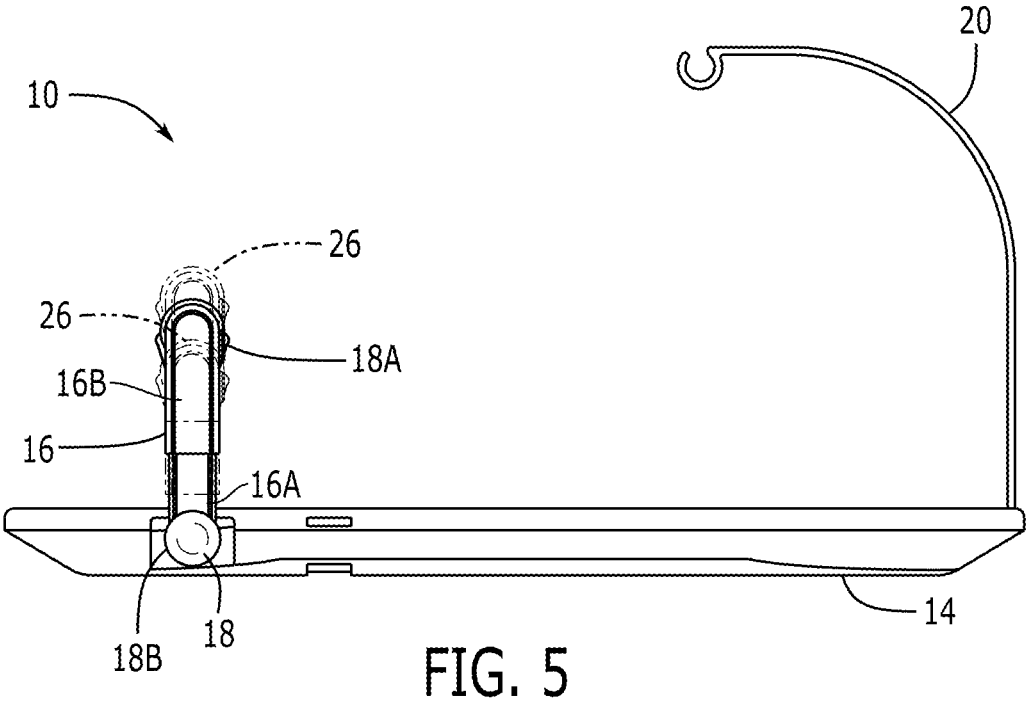
FIG. 5 is a side view of one embodiment of the present disclosure, showing alternate vertical positions 26 of the arm 16 in phantom.
Figure 6:
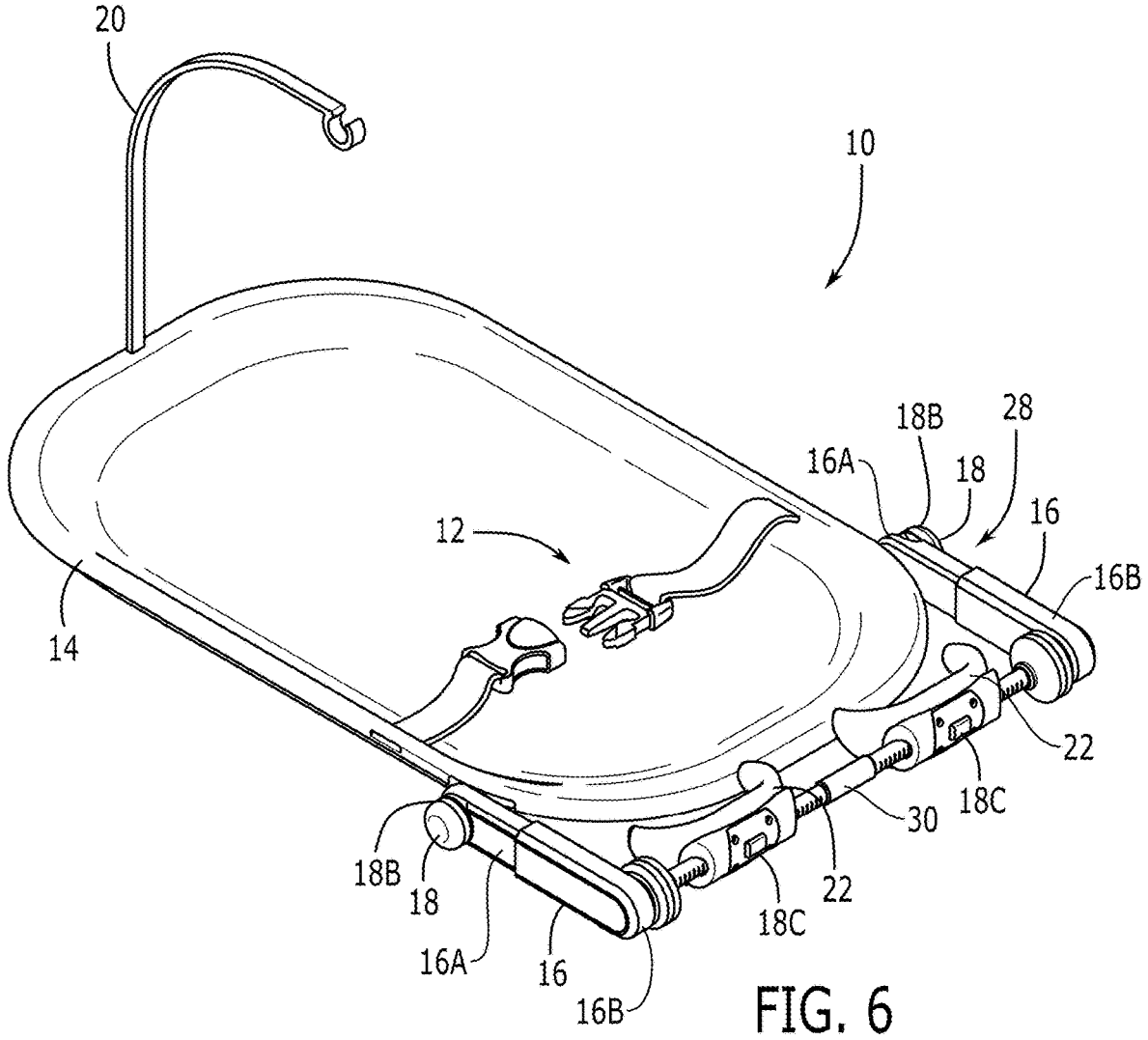
FIG. 6 is a perspective view of one embodiment of the present disclosure, showing the arm 16 in a folded position.

As mentioned above, the device 10 may comprise a pair of arms 16 disposed on opposite edges of the base 14. In embodiments, each arm 16 may be rotatably or pivotably attached to the base 14 such that the positioning of the arms 16 may vary with respect to the base 14. For example, during the use, the arms 16 may extend substantially upward from the base 14. However, depending on the size of the individual being changed or for storage or transport purposes, the arms may be rotated to alternate positions 24 and 28, as shown in FIGS. 4 and 6. In embodiments, a bottom end of the arm 16 may be operatively attached to the base at a hub 18, wherein the arm 16 may be locked into its desired position using a rotational adjustment button 18B. Each of the arms 16 may have an extendible length, as shown in FIG. 5, such that a height of the support rod 30 with respect to the base 14 may be adjusted. While the arms 16 may be extendible using any known means, in some embodiments, the arms 16 may comprise an upper arm 16B telescopically engaged with a lower arm 16A. For example, the upper arm 16B may comprise a shaft that surrounds the lower arm 16B, wherein the upper arm 16B may be configured to lock at a desired telescoping height with respect to the lower arm 16A using any known locking means, such as with a vertical adjustment button 18A extending from the upper arm 16B that removably engages with a plurality of slots on the lower arm 16A. Adjustability of the height of the extendable arms may provide for using the device of the present disclosure with various sized individuals. However, in some embodiments, the height of the arms may be fixed.

As mentioned above, the device 10 comprises a support rod 30 that extends between upper (or distal) ends of the arms 16. The support rod 30 may be a substantially cylindrical rod, wherein each of the stirrups 22 are operatively mounted to the support rod 30. In some embodiments, the stirrups 22 may extend outward from a carriage, wherein the carriage is configured to move about the length and the circumference of the support rod 30 to allow for positional adjustability of each stirrup 22. In some embodiments, the carriage and the stirrup 22 may be a singular unit. In any case, each stirrup 22 may be secured in its desired position using a stirrup adjustment button 18C, wherein depressing the button 18C allows for repositioning of the stirrup 22 and releasing the button 18C causes the stirrup to lock into place.

As shown in the Figures, the device 10 may further comprise a strap 12 configured to extend across a width of the base 14, wherein the strap 12 includes a strap buckle, such that the strap 12 may help prevent the baby 11 from making unwanted movements, which may increase the difficulty of diaper changing.

In some embodiments, the device 10 may further comprise a toy hook 20 attached to and extending from a head end of the base 14, wherein the toy hook 20 is configured to support a toy vertically above an individual being changed. The toy hook 20 may comprise an elongate, curved arm with a hook on a distal end thereof.

The device 10 of the present disclosure may be made of nay suitable materials and may have varying dimensions depending on the size of the individual to be changed.

To use the device 10 of the present disclosure, a user may adjust the height of the arms 16 and the positioning of the stirrups 22, as needed. A baby 11 or other individual may then be placed on the base 14 with his or her ankles or calves resting in the stirrups 22, wherein the baby 11 may be secured using the strap 12. The caregiver may then change the diaper, as normal. Once the diaper change is completed, the baby's legs may be removed from the stirrups 22, and the baby may be removed from the base 14.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A baby changing device for securing legs of an individual during a diaper change, the device comprising:

a base;

a pair of arms oriented parallel to one another and extending upwards from opposite edges of the base;

a support rod extending between upper ends of the pair of arms; and a pair of stirrups slidably and rotatably attached to the support rod, wherein:

each stirrup is substantially U-shaped and sized to cradle the individual's ankles.

2. The baby changing device of claim 1, wherein each arm of the pair of arms has an extendible length.

3. The baby changing device of claim 2, wherein:

the pair of arms comprises an upper arm telescopically engaged with a lower arm; and a vertical adjustment button is operatively attached to the pair of arms to secure a position of the upper arm with respect to the lower arm.

4. The baby changing device of claim 1, wherein the pair of arms are rotatably attached to the base.

5. The baby changing device of claim 4, wherein:

each stirrup of the pair of stirrups is attached to a respective carriage; and each carriage is configured to move about a length and a circumference of the support rod to allow for positional adjustability of each stirrup with respect to the support rod.

6. The baby changing device of claim 5, further comprising a stirrup adjustment button operatively attached to each stirrup and engaged with the support rod.

7. The baby changing device of claim 1, further comprising a toy hook extending upward from a head end of the base.

8. The baby changing device of claim 1, further comprising a strap with a strap buckle, the strap extending across a width of the base.

* * * * *